United States Patent [19]

Kirby

[11] 4,108,492

[45] Aug. 22, 1978

[54] BACK SUPPORT

[76] Inventor: Billy E. Kirby, 938 Vinecrest La., Richardson, Tex. 75080

[21] Appl. No.: 515,986

[22] Filed: Oct. 18, 1974

[51] Int. Cl.[2] ..... A47C 7/46; A47C 27/10

[52] U.S. Cl. ..... 297/284; 5/368; 297/218; 297/DIG. 3

[58] Field of Search ..... 297/284, 252, 230, 27, 297/352, DIG. 3, 218, 457; 5/349, 348 R

[56] References Cited

U.S. PATENT DOCUMENTS

| | | | |
|---|---|---|---|
| 1,422,915 | 7/1922 | Benson et al. | 297/457 |
| 2,253,801 | 8/1941 | Neal | 5/348 R |
| 2,306,673 | 12/1942 | Tucker | 297/252 |
| 2,672,183 | 3/1954 | Forsyth | 5/348 R |
| 3,019,051 | 1/1962 | Nugent | 297/218 |
| 3,154,345 | 10/1964 | Lambrecht | 297/452 X |
| 3,499,682 | 3/1970 | Orenstein | 5/348 R |
| 3,501,197 | 3/1970 | Burton | 297/457 |
| 3,813,716 | 6/1974 | Francis | 5/348 R |

*Primary Examiner*—Roy D. Frazier
*Assistant Examiner*—William E. Lyddane
*Attorney, Agent, or Firm*—Gerald G. Crutsinger; Larry B. Dwight

[57] ABSTRACT

A back support having a plurality of individually inflatable cushions extending horizontally across a frame and arranged such that air pressure may be adjusted in individual cushions to provide selective localized support to different areas of the back. A cross brace extends between spaced end frame members to furnish a firm support for each of the individually inflatable cushions to prevent undue deformation of the cushions.

1 Claim, 6 Drawing Figures

BACK SUPPORT

BACKGROUND OF THE INVENTION

The spinal column in man comprises 7 cervical, 12 dorsal, 5 lumbar, 5 sacral, and 4 coccygeal vertebrae. The vertebrae are movably secured together and in the normal spine form a double-S, reverse curve.

Chair backs generally have a substantially flat vertical surface which does not conform to the natural curvature of the back of a person sitting in the chair.

Improper support of the back of a person when sitting in a chair is a common cause of backache and pain in the lower back. Persons who sit at a desk or drive a vehicle for extended periods of time are often effected by this problem.

Typical automobile seats do not support the body properly and the lower back is usually in an awkward position with no support which results in poor sitting posture. Poor sitting posture causes muscle tension in the lower back if a person sits for an unusally long period of time, creating backaches and in some cases more serious spinal problems.

Heretofore, no device has been devised which is adjustable to the contour of the back of an individual while providing a firm support to relieve the spine of pressures exerted when a person is in the sitting position.

SUMMARY OF INVENTION

I have devised a back support cushion assembly having individually inflatable cushions supported in a vertical row in horizontally disposed compartments formed in a fabric suspended between rigid end frame members. The end frame members have cross braces or ribs extending horizontally therebetween and positioned adjacent the inflatable cushions to prevent deformation of the cushions.

A primary object of the invention is to provide a back support particularly adapted to furnish selective localized support to the lower back to prevent muscle strain when a person is in the sitting position.

Another object of the invention is to provide a back support including a plurality of cushions which may be inflated to different air pressures to adjust the physical dimensions and firmness of sections of the back support such that the contour of the back support may be adjusted for individual needs.

Another object of the invention is to provide a back support comprising a plurality of cushions each of which is inflatable to a different pressure such that the contour of the back support is shapeable to a prescribed contour to enhance the sitting posture.

A still further object of the invention is to provide a back support comprising a plurality of individually inflatable cushions wherein a brace member is positioned behind each cushion to prevent deformation of each cushion when pressure is exerted thereagainst.

Other and further objects of the invention will become apparent upon reading the detailed description hereinafter following and by referring to the drawings annexed hereto.

DESCRIPTION OF DRAWING

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
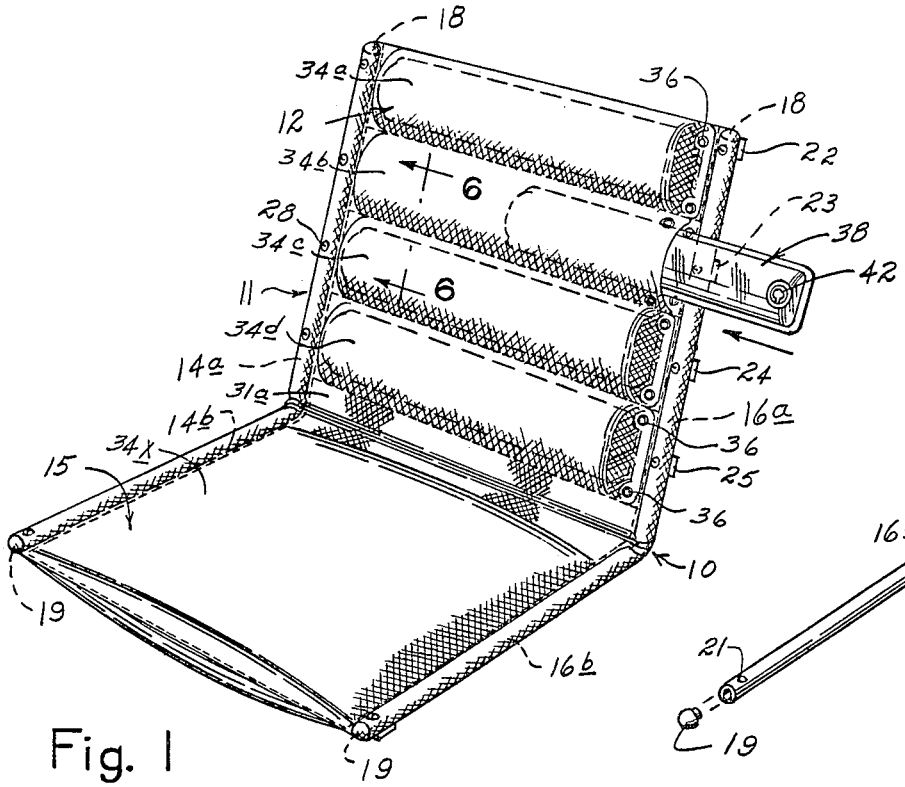
FIG. 1 is a front perspective view of the back support.

Referring to FIG. 1 of the drawing, the numeral 10 generally designates a back support comprising a general frame 11, a back support cushion assembly 12 and a seat cushion assembly 15.

Figure 3:
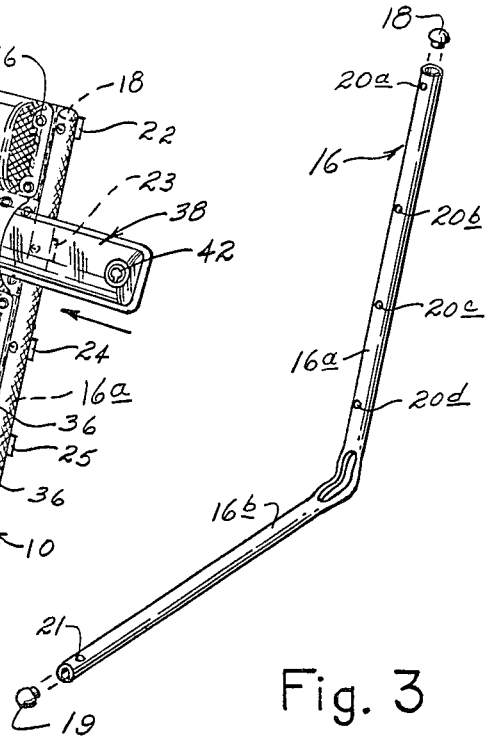
FIG. 3 is a perspective view of an end frame member.

The general frame 11 comprises spaced end frame members 14 and 16 of identical construction, one of which is illustrated in FIG. 3. End frame members 14 and 16 have substantially vertical back support members **14*a* and 16*a* secured thereto and substantially horizontally disposed seat support extensions 14*b* and 16*b***.

End frame members 14 and 16 preferably comprise rigid light weight structural members to prevent deformation of the back support cushion assembly 12 when positioned against a soft surface such as the back of an overstuffed chair or an automobile seat, as will be hereinafter more fully explained.

In the particular embodiment of the invention illustrated in the drawing end frame members 14 and 16 are formed from a hollow tubular member having a 90° bend in the central portion thereof. It should be appreciated however that the angle between the back support member **16*a* and the seat support extension 16*b*** may be more than 90° in some instances.

Closure caps 18 and 19 extend into the ends of back support portion **16*a* and seat support extension 16*b* of end frame 16** forming smooth, rounded ends thereon.

Spaced apertures **20*a*, 20*b*, 20*c*, and 20*d* are formed through the rigid back support members 14*a* and 16*a* on end frame members 14 and 16 and apertures 21 are formed through seat support extension portions 14*b* and 16*b***.

Figure 2:
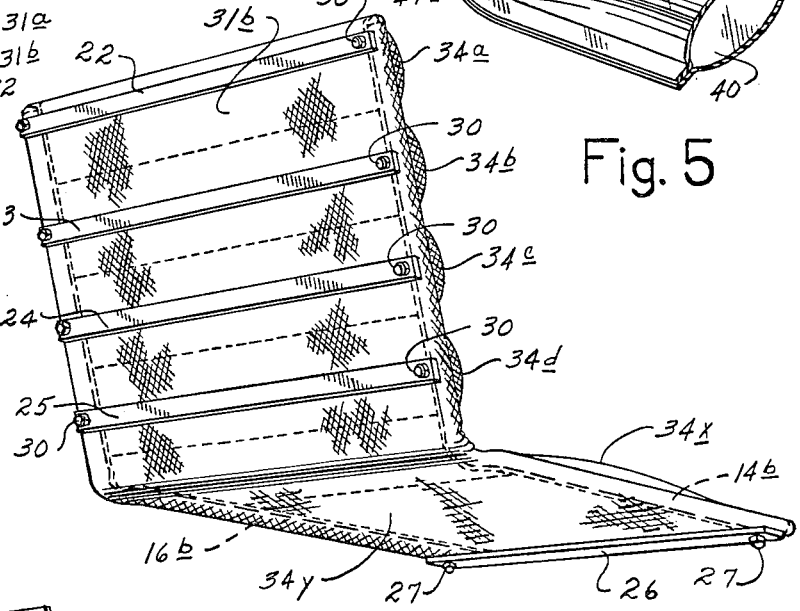
FIG. 2 is a rear perspective view of the back support.
Figure 4:
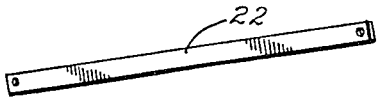
FIG. 4 is a perspective view of a cross brace member.

Rigid cross braces 22, 23, 24 and 25 have apertures formed in opposite ends thereof and are secured horizontally between end frame members 14 and 16, as best illustrated in FIG. 2. Cross brace members 22, 23, 24 and 25 may be secured in position by any suitable means such as bolts 28 extending through apertures **20*a* in the back support portion 16*a*** and through the apertures formed in the ends of the cross brace members.

A cross brace 26 has apertures extending through the opposite ends thereof and is secured by bolts 27 to the outer extremity of the horizontally disposed seat support extensions **14*b* and 16*b***.

As best illustrated in FIG. 1, the back support cushion assembly 12 comprises a cover, preferably formed from flexible stain resistant upholstery material. In the particular embodiment of the invention illustrated in the drawing the cover comprises a front panel **31*a* and a rear panel 31*b* secured together along three sides thereof to form a hollow slip cover. Pockets 34*a*, 34*b*, 34*c* and 34*d* are sewn onto front panel 31*a* of the slip cover to form spaced compartments which extend horizontally between end frame members 14 and 16**.

Figure 6:
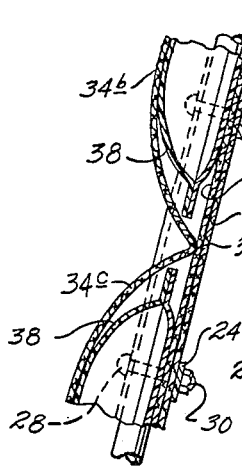
FIG. 6 is a cross-sectional view taken along line 6–6 of FIG. 1.

As best illustrated in FIG. 6 the front panel 31*a* of the slip cover is substantially flat while the pockets are formed by a seam 32 extending horizontally across the front panel 31*a*. It should be noted that pockets 34*b* and 34*c* are isolated one from the other.

As best illustrated in FIG. 1 of the drawing at least one end of each of the pockets 34*a*–34*d* has an opening formed therein through which an inflatable cushion 38 is insertable. In the illustrated embodiment each of the pockets has a flap formed on one end thereof which is connectable by snaps 36 to the front panel 31*a* of the slip cover.

As best illustrated in FIG. 2 of the drawing the pockets 34*a* –34*d* extend parallel to cross brace members 22–25. The lower cross brace members 24 and 25 preferably extend parallel to the central portion of the lower pockets 34*c* and 34*d* to prevent deflection of the inflatable cushions 38 rearwardly.

Figure 5:
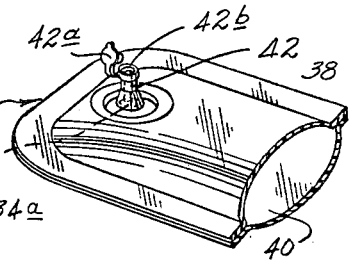
FIG. 5 is a fragmentary perspective view of an inflatable cushion.

Inflatable cushions 38 are constructed of resilient material and when inflated preferably have a substantially circular cross-section. As illustrated in FIG. 5 cushions 38 may comprise two pieces of resilient material such as rubber or plastic material secured together to form a hollow air receiving cavity 40. A filler valve is formed in the cushion 38 and communicates with cavity 40 therein. Filler valve 42 preferably has an orifice extending therethrough and a flexible flapper valve element 42*f* mounted therein such that air may be delivered inwardly through passage 42*b*. Air pressure in cavity 40 acting against flapper valve 42*f* moves the flapper vlave 42*f* into sealing engagement with surfaces about the orifice to prevent flow of air outwardly through opening 42*b*. The filler valve stem 42 is preferably constructed of resilient material such that air may be removed from cavity 40 by pinching the flexible valve stem 42 thereby deflecting flapper valve 42*f* to displace a portion thereof from the surfaces about the passage 42*b* such that air can flow outwardly through opening 42*b*.

From the foregoing it should be readily apparent that inflatable cushions 38 can be inflated to a maximum pressure and inserted into pockets 34*a*, 34*b*, 34*c*, and 34*d*. The contour of the back support is shapable by removing air from the respective cushions 38 such that the cushions 38 will be inflated to different pressures to adjust the physical dimensions and firmness of various sections of the back support for individual needs.

The seat cushion assembly 15 preferably comprises upper and lower panels 34*x* and 34*y* forming a pocket into which any suitable cushion may be inserted.

It should be readily apparent that the apparatus hereinbefore described accomplishes the objects of the invention hereinbefore set forth. It should be appreciated; however, that other and further embodiments of the invention may be devised without departing from the basic concept thereof. For example, end frame members 14 and 16 may be constructed to form a hinge element between back support portions 14*a* and seat support extensions 14*b* to permit folding the frame 11 to a relatively flat configuration if the back support is to be portable. Such hinges have been developed heretofore and have been used in lawn chairs to permit movement of the back of the chair to a desired angle relative to the seat of the chair and then locking the back of the chair in position.

Having described my invention I claim:

1. A back support comprising: a pair of horizontally spaced vertically extending frame members; vertically spaced horizontally extending frame members; means securing ends of said horizontally extending frame members to said vertically extending frame members; flexible front and rear panels secured together adjacent three edges to form a hollow slip cover having an open end; pockets secured to said front panel of the slip cover forming spaced horizontally extending compartments, each of said compartments being isolated one from the other, said slip cover being positioned over said vertically extending frame members such that each of said horizontally extending frame members is positioned adjacent to and parallel with one of said compartments; an inflatable cushion in each of said compartments; means on each cushion to vary pressure in each cushion independently of pressure in the other cushions; a seat cushion in said slip cover adjacent the open end thereof.

* * * * *